US007832434B2

(12) United States Patent
Carlins et al.

(10) Patent No.: US 7,832,434 B2
(45) Date of Patent: Nov. 16, 2010

(54) AUTOMATED FILLING SYSTEM FOR BULK LIQUID

(75) Inventors: James J. Carlins, Amherst, NY (US); John P. Maitino, Lewiston, NY (US); Ralph W. Gese, E. Aurora, NY (US); Jesse Sullivan, N. Tonawanda, NY (US)

(73) Assignee: Praxair Technology, Inc., Danbury, CT (US)

( * ) Notice: Subject to any disclaimer, the term of this patent is extended or adjusted under 35 U.S.C. 154(b) by 915 days.

(21) Appl. No.: 11/724,639

(22) Filed: Mar. 15, 2007

(65) Prior Publication Data

US 2008/0223874 A1 Sep. 18, 2008

(51) Int. Cl.
*B65B 1/30* (2006.01)

(52) U.S. Cl. ..... 141/83; 141/59; 141/95; 141/197; 141/382; 141/387

(58) Field of Classification Search ..... 141/2, 141/4–8, 59, 67, 83, 94, 95, 192, 198, 382, 141/387; 73/1.02

See application file for complete search history.

(56) References Cited

U.S. PATENT DOCUMENTS

| | | | | |
|---|---|---|---|---|
| 4,098,303 | A * | 7/1978 | Gammell | 141/52 |
| 4,805,672 | A | 2/1989 | Berrettini et al. | |
| 4,856,284 | A * | 8/1989 | Mattiola et al. | 62/50.7 |
| 6,622,758 | B2 | 9/2003 | Drube et al. | |
| 6,648,021 | B2 * | 11/2003 | Zheng et al. | 137/884 |
| 6,681,815 | B1 * | 1/2004 | Westrich et al. | 141/95 |
| 7,591,290 | B2 * | 9/2009 | Bourgeois et al. | 141/83 |

* cited by examiner

*Primary Examiner*—Timothy L Maust
(74) *Attorney, Agent, or Firm*—David M. Rosenblum

(57) ABSTRACT

An automated filling system to conduct a filling operation in which a bulk liquid transport vehicle is filled with a bulk liquid and quality assurance tests are performed by a gas analyzer. A programmable logic controller, employed to control the filling operation, is responsive to pressure within a fill line connected to the vehicle and is programmed to determine that there exists sufficient pressure within the vehicle to conduct an initial quality assurance test and that the fill line is properly connected to the fill line, without breaks in its flow integrity. The programmable logic controller also initiates and controls a pressurization process if there is not sufficient pressure to conduct the initial quality assurance test.

10 Claims, 5 Drawing Sheets

WARNING!

There is not enough pressure in the fill hose to satisfy the Fill Hose Pressure Permissive.

Go to the fill bay and verify the following:

- Correct product's fill hose is connected in the correct fill bay.
- Manual valves on the trailer are positioned correctly.

To initiate the Trailer Pressurization Process (TPP) select CONTINUE, or select CANCEL to abort the filling process.

[CONTINUE] * [CANCEL]

TPP1

FIG. 3

Trailer Pressurization Process (TPP)

Verify the fill bay area is clear of personnel.

If satisfied that the trailer is properly connected in the correct fill bay:

- Press the TPP button in that fill bay.
- The TPP light in that fill bay will turn on if the proper TPP button was pushed.
- The TPP process will not begin until the filler returns to this terminal and selects the START TPP button.

The TPP process will abort if an incorrect TPP button is pushed or if no TPP button is pushed in the given amount of time.

TPP2

FIG. 5

Trailer Pressurization Process (TPP)

There is not enough pressure in the fill hose to satisfy the Fill Hose Pressure Permissive. Neither the TPP or FILL & QA process can proceed without assistance from plant personnel.

The Trailer Pressurization Process was stopped for one of the following reasons:

- cancelled by filler
- inactivity timeout
- incorrect TPP button pressed
- maximum number of attempts reached

[OK]

TPP4

TPP screen #4

FIG. 4

Trailer Pressurization Process (TPP)

The TPP button has been pressed in the correct fill bay.

To start the Trailer Pressurization Process select START TPP, or select CANCEL to abort the filling process.

[START TPP] [CANCEL]

In case of leaks or other hazard, press the EMERGENCY STOP or FILL ZONE AREA ISOLATION button to abort the TPP.

TPP3

FIG. 6

AUTOMATED FILLING SYSTEM FOR BULK LIQUID

FIELD OF THE INVENTION

The present invention relates to an automated system for conducting a filling operation to fill a bulk liquid transport vehicle with a bulk liquid in which the filling operation is controlled by a programmable logic controller that responds to pressure within a fill line to assure flow integrity of a fill line connected between a source of the bulk liquid and the bulk liquid transport vehicle and sufficient pressure to a gas analyzer employed for quality assurance testing of bulk liquid contained in the bulk liquid transport vehicle.

BACKGROUND OF THE INVENTION

Bulk liquid products such as liquefied industrial gases, are transported to consumers over the road by bulk liquid transport vehicles such as tractor-trailer combinations. The trailer is filled by connecting the trailer to a storage tank or other source of bulk liquid with the use of a fill line and then opening a fill valve to fill the trailer with the bulk liquid.

Typically, quality assurance tests are conducted to ensure that the bulk liquid to be distributed to customers by the trailer meets certain purity and compositional specifications. This is a two step process that begins before the filling process begins by sampling vapor from the trailer with the use of a gas analyzer to make certain that the gas meets overall purity specifications. After the filling process has been completed, vapor from within the trailer is again sampled and more extensive tests are performed that involve quantifying the composition of the vapor.

As can be appreciated, if the fill line is not connected to the trailer when the fill valve is opened from the storage tank, the liquid will simply flow into the bay area in which the filling operation is conducted. This can be particularly dangerous in case of liquid oxygen or other types of bulk liquids to be transported, for example, hydrocarbon containing liquids.

In addition, a further problem exists with respect to the use of the gas analyzer. For most gas analyzers, there must be sufficient vapor pressure within the trailer prior to the commencement of the filling operation in order for the gas analyzer to properly function. If the vapor pressure is too low the gas analyzer will not function and in such case, the quality assurance test fails. If there exists sufficient liquid within the trailer, the driver can build pressure within the trailer and attempt to conduct the test a second time. If there is not sufficient liquid within the trailer, specialized plant personnel are then called to pre-pressurize the trailer. This results in unacceptably long and expansive delays in concluding the filling operation.

In the prior art, it has been known to somewhat automate the filling process with the use of pressure switches and transducers to ascertain whether sufficient pressure exists within the fill line to infer that the fill line is in fact connected to the trailer or there exists a break in the fill line. The pressure that is measured arises from residual liquid within the trailer prior to the filling operation. The problem remains, however, even if the fill line is at a suitable pressure, there might not be sufficient pressure within the trailer for the gas analyzer to properly function.

As will be discussed, the present invention provides an automated system for conducting a filling operation in which not only is it assured that the fill line is connected between the source of the bulk liquid and the trailer but that there also exists sufficient vapor pressure within the trailer for the gas analyzer to properly function.

SUMMARY OF THE INVENTION

The present invention provides an automated system for conducting a filling operation to fill a bulk liquid transport vehicle with a bulk liquid. It is to be noted, that the term "bulk liquid transport vehicle" means any vehicle capable of transporting a bulk liquid, for example, a trailer of a tractor-trailer combination.

The automated system includes a pressure transducer for generating a pressure signal referable to pressure within a fill line providing flow communication with a source of the bulk liquid to the bulk liquid transport vehicle. In this regard, the term "source of the bulk liquid" as used herein and in the claims means any source capable of storing the bulk liquid, for example an insulated tank in case of cryogenic liquids such as liquid oxygen or liquid nitrogen. Additionally, the system also includes a fill valve operable to be set in an open position and a closed position to control the flow of bulk liquid in the fill line, a pump to pump liquid through the fill line and a gas analyzer connected to the bulk liquid transport vehicle by an instrument line to analyze vapor evolved from the bulk liquid within the bulk liquid transport vehicle. The fill valve and the gas analyzer are controlled by a programmable logic controller.

The programmable logic controller is responsive to the pressure signal and is programmed to control the filling operation. Such programming terminates the filling operation if the pressure is below a first pressure indicative of a lack of flow integrity between the source of the bulk liquid and the bulk liquid transport vehicle. The term "flow integrity" as used herein and in the claims means any loss of flow integrity such as by leakage or failure within the fill line or any connection fitting or the fill line simply not being connected to the bulk liquid transport vehicle.

Additionally, the programming causes initiation pressurization of the bulk liquid transport vehicle if the pressure is above the first pressure but below a second pressure necessary for the gas analyzer to properly function by setting the fill valve in the open position and setting the fill valve in the closed position after an elapse of a preset time interval, thereby to introduce an amount of the bulk liquid into the bulk liquid transport vehicle through the fill line. Assuming that the pressure is above the second pressure, the programming initiates measurement of purity of the vapor with the gas analyzer. If the purity of the vapor is below a predetermined purity, the filling operation is terminated. If the purity of the vapor, however, is at least at the predetermined purity, the programmable logic controller is programmed to initiate filling of the bulk liquid transport vehicle with the bulk liquid by setting the pump in the on condition.

Preferably, the automated system entirely automates the filling operation by terminating the filling operation when the bulk liquid transport vehicle has been filled with the bulk liquid. This can be accomplished by inclusion of a device operable to measure a quantity referable to an amount of the bulk liquid within the bulk liquid transport vehicle and to generate a quantity signal referable to the amount of the bulk liquid within the bulk liquid transport vehicle. In such case, the programmable logic controller is responsive to the quantity signal and is programmed to set the pump in the off condition when the amount of the bulk liquid within the bulk liquid transport vehicle is at a predetermined amount. Furthermore, the programmable logic controller can also be programmed to initiate a measurement of composition of the vapor after the pump has been set in the off condition to perform the final quality assurance test. The device indicative of the quantity of bulk liquid within the bulk liquid transport vehicle can be a scale and therefore, the quantity signal is referable to the amount of the bulk liquid contained within the bulk liquid transport vehicle by being referable to the weight of the bulk liquid transport vehicle.

The pump can be operable to be set in an on condition to pump the liquid and an off condition to turn off the pump. In such case, the programmable logic controller also controls the pump and can be programmed such that the pump is set in the on condition for the preset time interval. After the elapse of the preset time interval, the pump is set in the off condition.

Additionally, the programmable logic controller can be programmed to reinitiate pressurization of the bulk liquid transport vehicle if the pressure remains below the second pressure necessary for the gas analyzer to properly function after a prior attempt to pressurize the bulk liquid transport vehicle. In such case, the programmable logic controller has a counter to count a number of sequential attempts to pressurize the bulk liquid transport vehicle and is programmed to terminate the filling operation if the number of sequential attempts to pressurize the bulk liquid transport vehicle is equal to a predetermined count.

In any embodiment of the present invention, preferably the control logic program is programmed such that the pressure is first tested for the second pressure and if the pressure is below the second pressure, to then test for the first pressure. Additionally, the programmable logic controller can be programmed to enable the pressurization of the bulk liquid transport vehicle for specific logon identifications of users certified to conduct bulk liquid transport vehicle pressurization operations that are entered into a supervisory control and data acquisition program connected to the programmable logic controller. In any embodiment of the present invention, a manual interlock switch can be located in the vicinity in which the filling operation is to be conducted, connected to the programmable logic controller and accessible by the users. In such case, the programmable logic controller is programmed such that the manual interlock switch must be manipulated by the users before pressurization of the bulk liquid transport vehicle is initiated.

As can be appreciated by the description of the present invention, since the pressurization of the bulk liquid transport vehicle is conducted without operator intervention, the user or operator does not have to be trained as rigorously as personnel that are charged with conducting manual pressurization operations. Moreover, since the pressurization process is automated, the time bottlenecks in the filling process that are produced by quality assurance failures resulting from the lack of adequate pressure in the instrument line to the gas analyzer are eliminated.

BRIEF DESCRIPTION OF THE DRAWINGS

While the specification concludes with claims distinctly pointing out the subject matter that Applicants regard as their invention, it is believed that the invention will be better understood when taken in connection with the accompanying drawings in which:

FIGS. 2-1, 2-2 and 2-3 is a logic diagram of the control logic used in a programmable logic controller employed in an automated system in accordance with the present invention;

FIG. 3 is an example of a diagnostic message produced by the control logic program illustrated in FIG. 2;

FIG. 4 is an example of a diagnostic message produced by the control logic program illustrated in FIG. 2;

FIG. 5 is an example of a diagnostic message produced by the control logic program illustrated in FIG. 2; and FIG. 6 is an illustration of a diagnostic message produced by the control logic program illustrated in FIG. 2.

DETAILED DESCRIPTION

Figure 1:
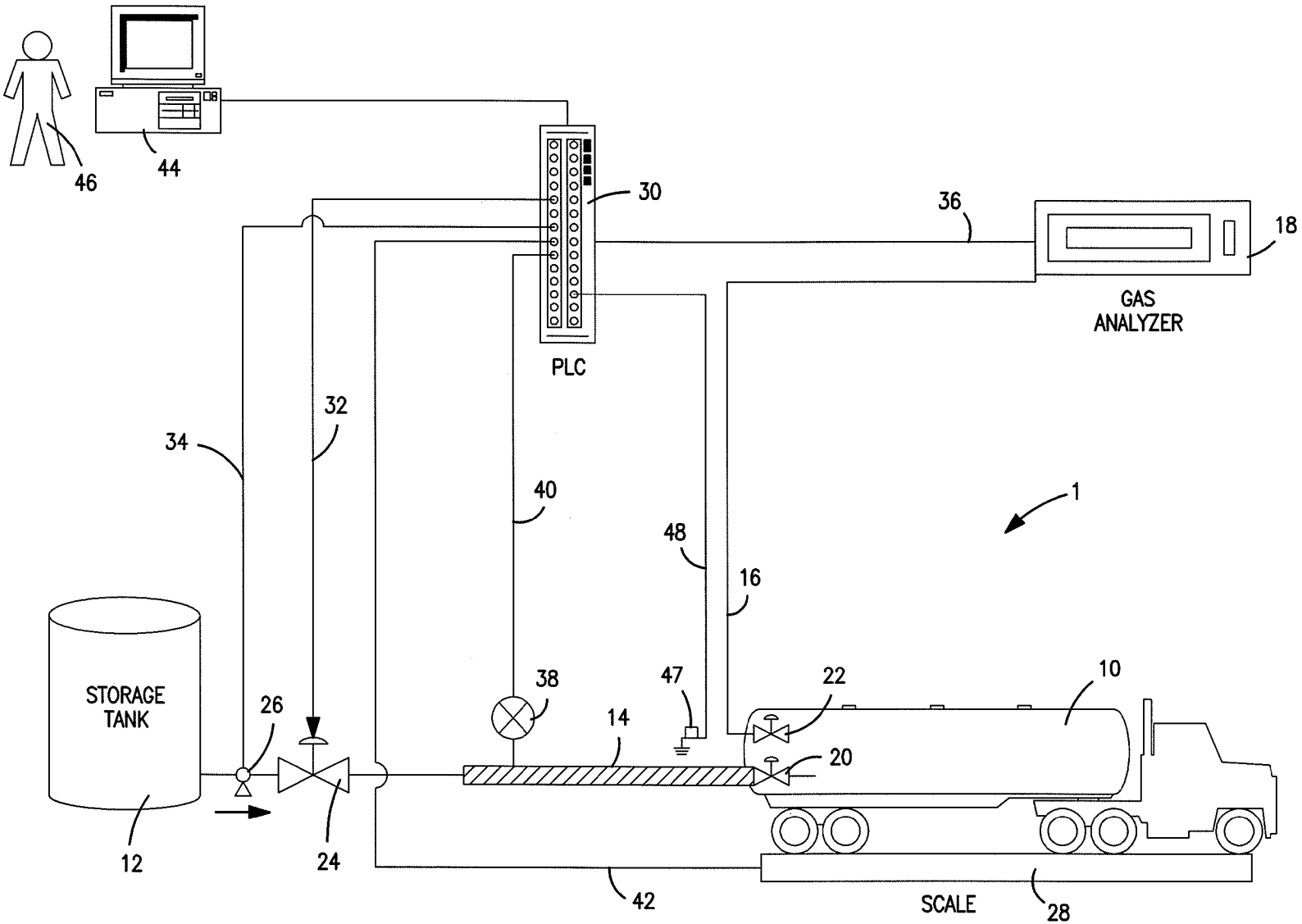
FIG. 1 is a schematic illustration of a fill bay for a trailer of a tractor-trailer combination incorporating an automated system in accordance with the present invention.

With reference to FIG. 1, a fill bay 1 is illustrated of the type that is commonly used in filling a trailer 10 to be filled with a bulk liquid contained in a source of bulk liquid that in the illustration is a storage tank 12.

During a filling operation, a fill line 14 is connected to the trailer 10 to allow the bulk liquid to flow into the trailer 10 from the storage tank 12. Additionally, an instrument line 16 is also connected to the trailer 10 to allow vapor evolved from bulk liquid within the trailer 10 to be sampled by a gas analyzer 18 for quality assurance purposes. A hand valve 20 can be set from a closed position to an open position when it is desired to fill trailer 10 with the bulk liquid. Additionally, a hand valve 22 is provided in the trailer 10 that likewise can be set from a closed to an open position to allow the vapor to flow from a head or ullage space within trailer 10 to gas analyzer 18.

Control of the flow within fill line 14 is provided by a remotely activated fill valve 24 that can be set in an open position to allow the fluid to enter the fill line 14 and therefore, the trailer 10 and a closed position when such flow is to be terminated. Additionally, a remotely activated pump 26 is provided to pump the bulk liquid through the fill line 14 and is able to be remotely set into an on condition to pump the bulk liquid and an off condition in which pumping ceases. In some systems, such as those with multiple storage tanks or fill bays, remotely activated pump 26 may operate continuously in recirculation mode when not filling a trailer and control of bulk liquid being transferred to the trailer is controlled by placing the fill valve 24 in the open or closed position.

A scale 28 is provided within fill bay 1 to weigh the tractor-trailer combination and from such weight measurement to discern the amount of the bulk liquid contained in trailer 10 by weighing before and after the filling operation is complete. It is to be noted that devices could be provided for determining the amount of bulk liquid contained in trailer 10, for example, by liquid level measurements within trailer 10.

A programmable logic controller 30 is provided to control the filling operation conducted within fill bay 1. Programmable logic controller can be an Allen-Bradley PLC5, available from Rockwell Automation of 1201 South Second Street, Milwaukee, Wis. 53204 U.S.A. containing a computer software program and control logic written using Rockwell Automation software. Programmable logic controller exerts control by controlling the operation of fill valve 24, pump 26 and gas analyzer 18 remotely by way of electrical connections 32, 34 and 36, respectively. Such control is responsive to inputs of pressure measurements of pressure within fill line 14 by pressure transducer 38, transmitted by electrical connection 40 as a pressure signal to programmable logic controller 30, gas analysis measurements provided by gas analyzer 18 transmitted by electrical connection 36 and weight measurements provided by scale 18 by electrical connection 42 that are indicative of the amount of the bulk liquid contained in trailer 10. The weight measurements are transmitted to programmable logic controller 18 by a signal referable to the weight measurement by an electrical connection 42. As can be appreciated, alternative methods for controlling the filling operation can employ a flowmeter to determine the amount of bulk liquid pumped to trailer 10 and therefore, whether the filling operation has been completed.

Figures 1, 2:
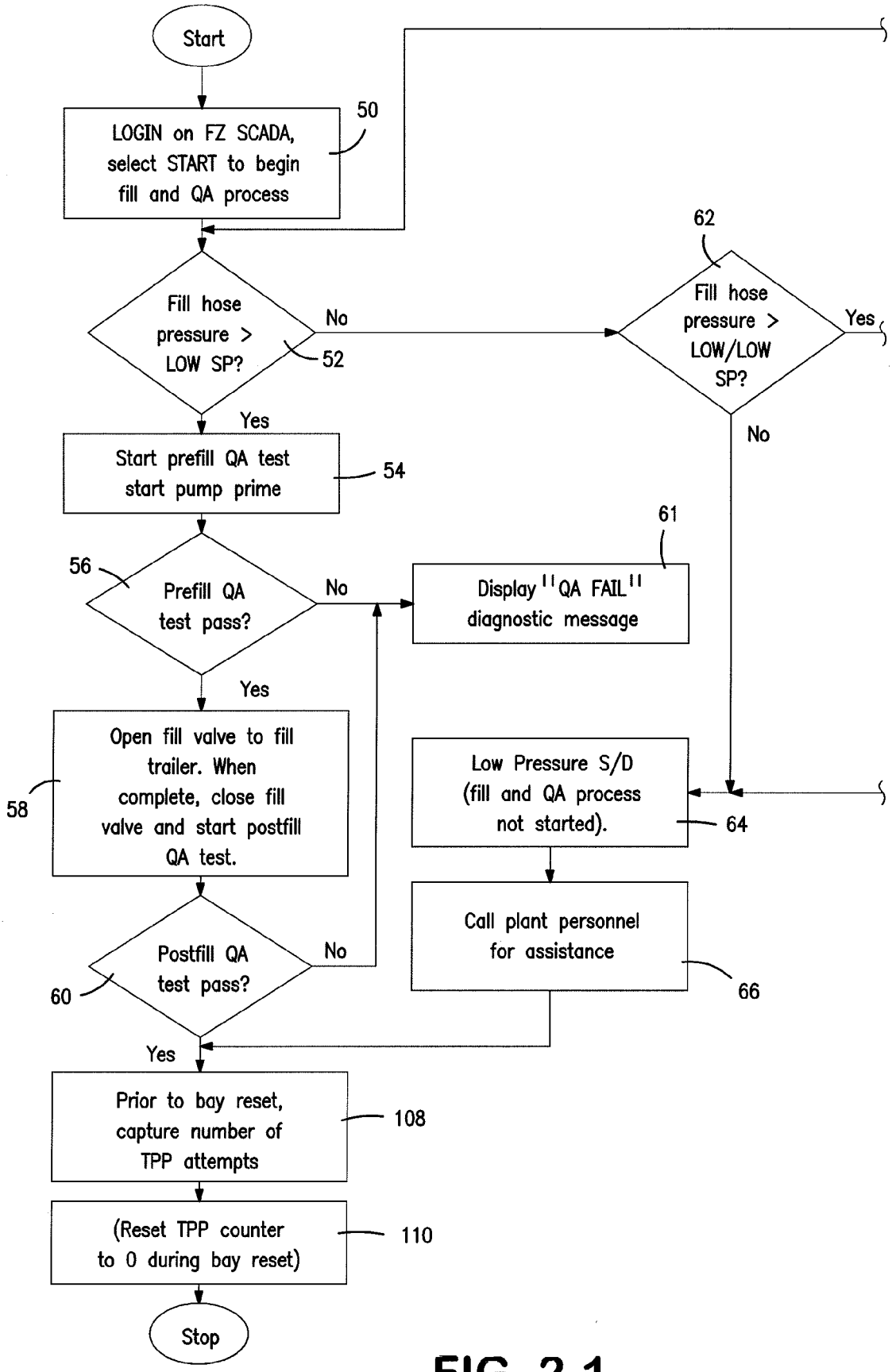
Figure 2:
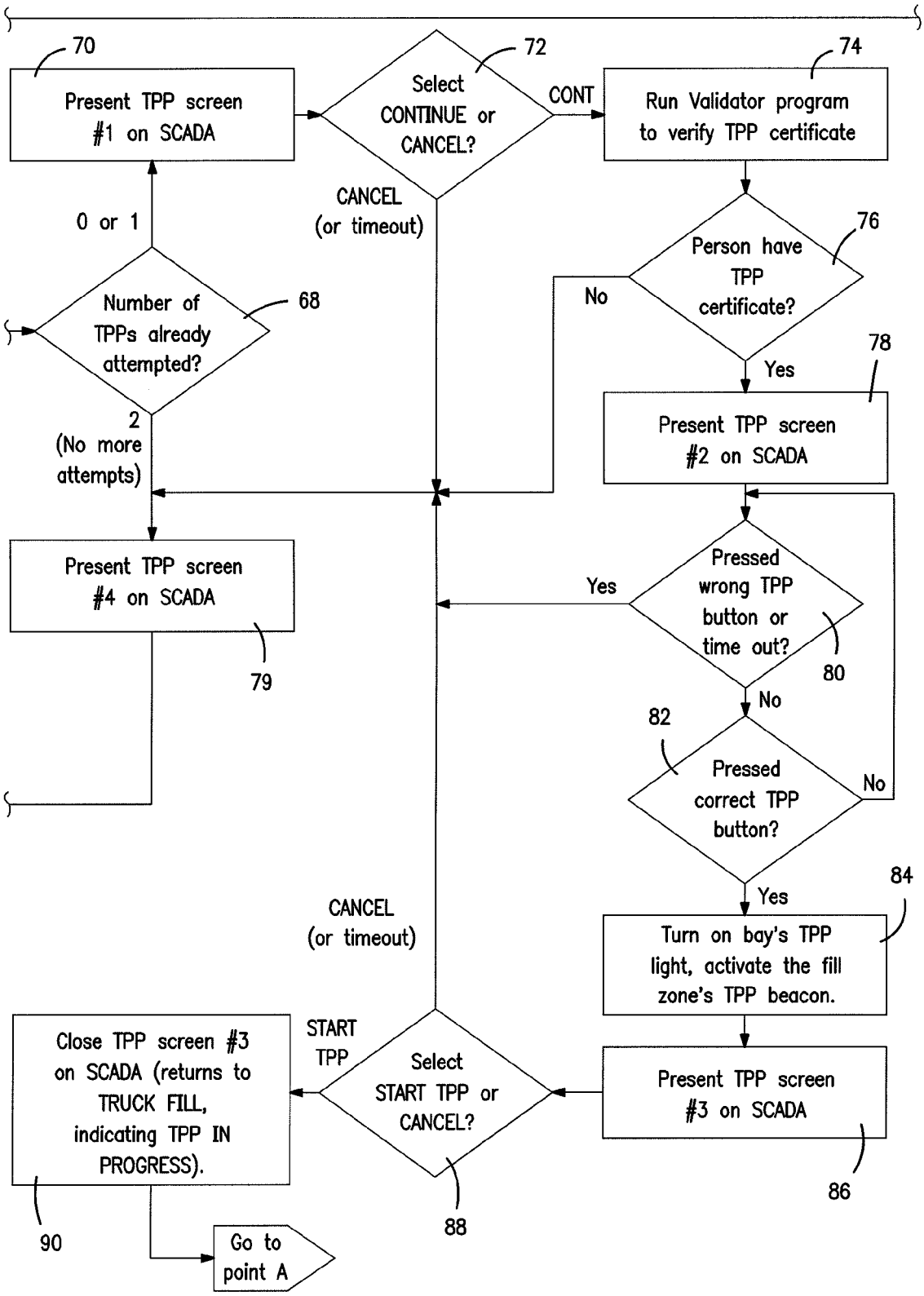
Figures 2, 3:
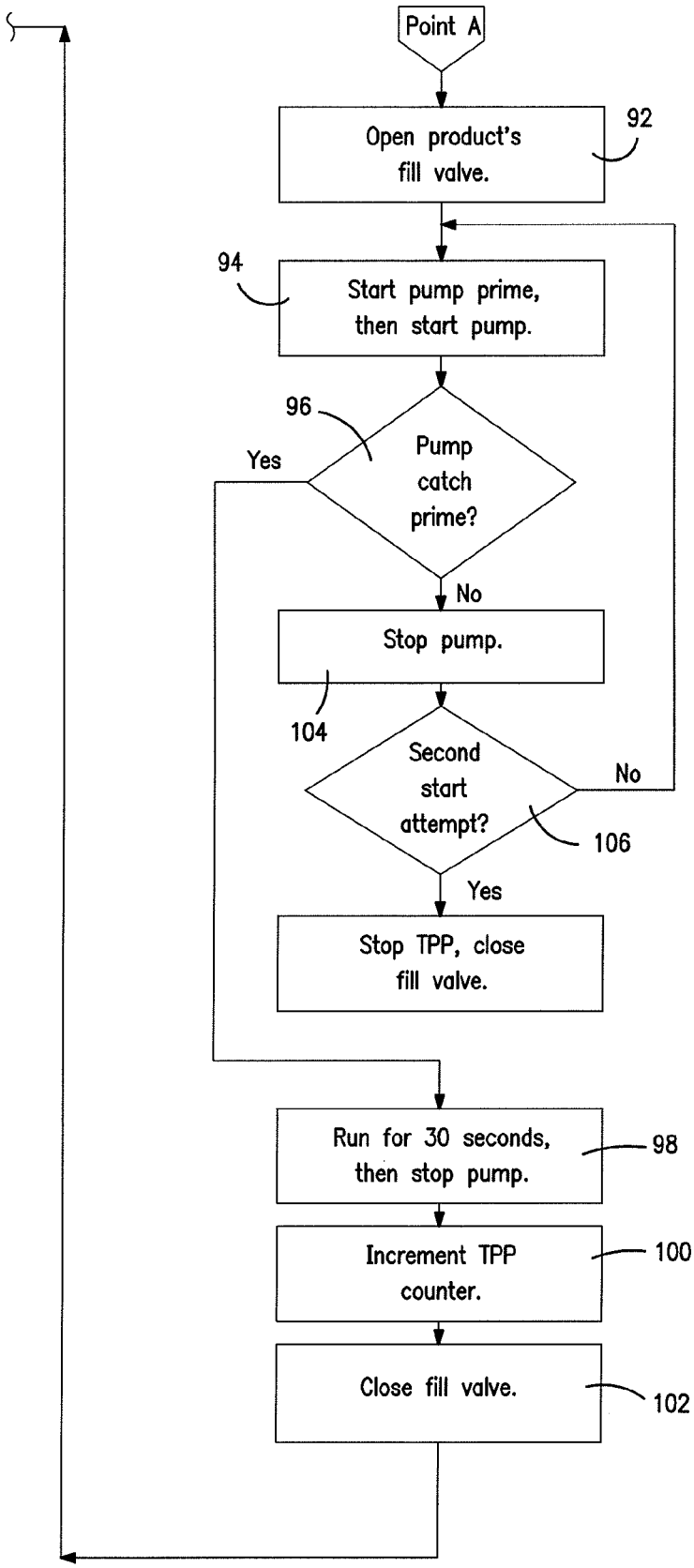

With additional reference to FIGS. 2-1, 2-2 and 2-3, the control logic programmed in the programmable logic controller 30 is illustrated. Additionally, the interaction between such control logic and a supervisory control and data acquisition system contained in a personal computer 44 is also illustrated. The personal computer 44 has a screen and keyboard as a human interface with a user 46. The supervisory control and data acquisition system can be a FIX32 operator interface installed on the personal computer 44 available from GE Fanuc Automation, Inc., of 2500 Austin Drive, Charlottesville, Va. 22911 U.S.A. Personal computer 44 can have a MICROSOFT WINDOWS XP operating system and additional MICROSOFT VISUAL BASIC software programs can be written and installed to provide additional functionality such as user login and certification verification. After trailer 10 is positioned on scale 28 and fill line 14 and instrument line 16 are connected to trailer 10, hand valves 20 and 22 are set in open positions. User 46 then enters in a logon ID in the supervisory control and data acquisition system with the use of personal computer 44 and then, as indicated in step 50, initiates the execution of the control logic programmed within programmable logic controller 30. As can be appreciated, the supervisory control and data acquisition program might reside on another digital device with the same simply accessed by the personal computer 44. Preferably, on the logon screen, an option is provided to simply "start" the execution of the same. At this point, the pressure within fill line 14 is tested as indicated in a step 52 to determine whether the pressure within fill line 18 as measured by pressure transducer 38 is above a pressure ("LOW SP") that is required for gas analyzer 18 to properly function. Typically, this pressure is about 10 psi and arises from residual bulk liquid contained in trailer 10.

If the pressure is above such pressure, as indicated in step 54, a pre-fill quality assurance test is performed by initiating operation of gas analyzer 18 to make a measurement of a predetermined purity level of the vapor within trailer 10. At the same time, fill valve 24 is opened and pump 26 is primed. At this point pump 26 may run in a recirculation mode of operation after successful prime with no bulk liquid entering fill line 14. Although not illustrated, but as would be known in the art, pump 26 is provided with its own control system, automated valves and return lines for such purposes.

As indicated in step 56, the purity level is then compared to a purity level that has been preset within control logic program programmed within programmable logic controller 30 to determine if it meets such specification. If the answer is in the affirmative, as illustrated in step 58, the control logic causes programmable logic controller 30 to open fill valve 24 and set the pump 26 in an on condition to commence filling trailer 10. When the weight sensed by scale 28 and transmitted to programmable logic controller 30 as the quantity signal indicates that trailer 10 has been filled, the control logic then causes programmable logic controller to close fill valve 24 and to set the pump 26 in an off condition as also shown in step 58.

The execution of the control logic then causes gas analyzer 18 to perform a second quality assurance test by determining the composition of the vapor evolved from the bulk liquid now filling trailer 10. This composition is compared with a preset composition specification as indicated in step 60. If this test fails, a diagnostic message appears as indicated in step 61, indicating failure, namely, "QA FAIL". The same message is displayed upon failure of the initial pre-fill quality assurance test performed in step 56. In case of either of such failures, execution of the filling operation terminates with the display of the diagnostic message on personal computer 44.

Turning again to step 52 if the pressure within fill line 14 is below the pressure necessary for the gas analyzer 18 to properly function, a pressurization process is conducted. The next step as indicated in step 62 is to test whether the pressure in fill line 14 is above a pressure ("LOW/LOW SP") that is indicative that there is a lack of flow integrity between the storage tank 12 and the trailer 10. This pressure can be set at about 0.5 psi. Again, examples of a lack of such flow integrity are a leak within fill line 14 or fill line 14 is not properly connected to trailer 10.

Assuming that the test in step 62 fails, as indicated in step 64, a diagnostic message will be displayed on personal computer 44 indicting the low pressure and that the fill and quality assurance process has not started. Additionally, another diagnostic message will be displayed on personal computer 44, as shown in step 66, to call plant personal for assistance.

If the test performed in step 62 indicates that the pressure within the fill line 14 is above the pressure that would indicate a loss of low integrity, a pressurization process for trailer 10 is initiated that is referred to in FIG. 2 as "TPP". As a first step, the number of times that trailer pressurization has been attempted is tested within a step 68 by comparing the present attempt with prior attempts as registered by a counter. Preferably, only two attempts at trailer pressurization are allowed and thus, assuming that no prior attempts have been made or only one prior attempt has been made a diagnostic message is sent to the personal computer 44 as indicated in step 70. This message can be in the form shown in FIG. 3 that informs user 46 to verify that the correct product hose or fill line 18 has been connected and that valves 20 and 22 are set in proper positions. User 46 can respond by either electing to continue or cancel the pressurization process as illustrated by step 72.

Assuming that user 46 elects to continue in step 72, as indicated in step 74, a validation program is then run to verify user 46 is certified to conduct trailer pressurization processes searching a data base and comparing the same with the logon ID used by user 46.

If the user 46 does not have requisite training to conduct such a trailer pressurization process, as indicated in step 76, execution of the control logic proceeds to step 78 in which a message is sent to personal computer 44 the type shown in FIG. 4 that the trailer pressurization process and the quality assurance process can not proceed as shown in step 79. The same message will be sent to personal computer 44 to cover situations in which the number of trailer pressurization attempts is greater than two as a result of the test in step 68 and the counter registering "2".

Assuming that user 46 is properly certified, a message is then sent to personal computer 44, as indicated in step 78, preferably in the form of FIG. 5. This message indicates that the user 46 must in fact make certain that the fill bay area is clear of personnel and that the trailer 10 is properly connected in the proper fill bay, for example, one used for filling with oxygen as opposed to nitrogen. Preferably, in order to insure that the user 46 actually visits the fill bay 1, an interlock switch that can be in the form of a push button 47 connected to programmable logic controller 30 by an electrical connection 48. Although other types of switches can be used, preferably push button 47 is of the type that lights when pressed. Push button 47 is located in fill bay 1 and is accessible by the user 46 to make certain that the user 46 actually visits the fill bay 1 in the vicinity where the filling operation is conducted to verify that the trailer 10 is properly connected in the correct fill bay for the filling operation to be conducted. If there is a time out or the wrong TPP button is pressed, in other words user 46 visited the incorrect fill bay, the trailer pressurization process will abort. As indicated in step 80 if the wrong button is pressed or there is a time out, a message is displayed in the form of FIG. 4 on personal computer 44 and then, the diagnostic messages indicated in steps 64 and 66 will sequentially occur.

Assuming there is no time out and the correct TPP button has been pressed, step 82 will be reached and again, it will be determined whether the correct TTP button has been pressed. If the incorrect button has been pressed, the control logic program loops back to step 80.

If, as indicated in step 82, the correct TPP button has been pressed, the programmable logic controller 14 will proceed as indicated in step 84 to turn on a light (not illustrated) in fill bay 1 and activate a TPP beacon as a warning. At step 86, a message is then displayed in the form shown in FIG. 6 to allow user 46 to either start or cancel the trailer pressurization process. If the process is cancelled or times out, as shown in step 88, the message of FIG. 4 is displayed and the program proceeds to logic steps 64 and 66 also displaying the diagnostic messages thereof on personal computer 44.

Assuming that start is selected on the screen in FIG. 6 and as provided for in step 88, as shown in step 90, the message shown in FIG. 6 is closed and a message is displayed indicating that the trailer pressurization process is in progress. In the trailer pressurization process, beginning at step 92, fill valve 24 is set in an open position and in step 94 the pump is started by first priming the pump 26 and then testing in step 96 to verify whether the pump 26 is primed. If priming has been successful, the pump 26 is run for 30 seconds as indicated in step 98. The trailer pressurization process counter is incremented as shown in step 100 for testing in step 68 and the fill valve 24 is then closed in step 102. At this point, the program returns to step 52 and the fill line pressure is again tested to make certain that it is above that necessary for the gas analyzer 18 to properly function. Again, in an alternative operation, pump 26 may continuously be on and only the fill valve 24 is set in open and closed positions for the duration of a preset time interval, 30 seconds in the illustrated embodiment.

If priming is not successful, however, pump 26 is set in an off condition as provided for in step 104. The attempts to prime pump 26 are then tested in step 106 and if it is the second attempt, the trailer pressurization process is terminated and fill valve 24 is closed. If however, the attempt is the first attempt, as indicated in the test of step 106, execution of the program proceeds back to step 94.

After a successful quality assurance test in step 60 or after step 66 has executed, in step 108, the number of trailer pressurization steps is then captured on the supervisory control and data acquisition program within personal computer 44. The counter that has been incremented in step 100 is then reset to zero in step 110.

It is to be noted that the present invention contemplates less sophisticated approaches for the control logic programming to be used in connection with programmable logic controller 30. For example, although as indicated in step 58, the filling process proceeds until the trailer has been filled with a predetermined amount of bulk liquid, once the filling process has been started, it is possible that the programming could allow the user 46 to terminate the filling process manually by monitoring the amount of bulk liquid. Also, although in step 52, the pressure is first tested to determine whether there exists sufficient pressure to use the gas analyzer 18, the pressure could first be tested to assure flow integrity between the storage tank 12 and the trailer 10. Furthermore, it is possible to practice an embodiment without the interlock in the fill bay and the numerous diagnostic messages outlined above.

While the present invention has been described with reference to a preferred embodiment, as will occur to those skilled in the art, numerous changes and additions and omissions can be made without departing from the spirit and the scope of the present invention as set forth in the presently pending claims.

We claim:

1. An automated system for conducting a filling operation to fill a bulk liquid transport vehicle with a bulk liquid comprising:

a pressure transducer for generating a pressure signal referable to pressure within a fill line providing flow communication with a source of the bulk liquid to the bulk liquid transport vehicle;

a fill valve operable to be set in an open position and a closed position to control the flow of bulk liquid in the fill line;

a pump to pump liquid through the fill line;

a gas analyzer connected to the bulk liquid transport vehicle by an instrument line to analyze vapor evolved from the bulk liquid within the bulk liquid transport vehicle; and a programmable logic controller responsive to the pressure signal and controlling operation of the fill valve and the gas analyzer, thereby to control the filling operation, the programmable logic controller programmed such that:

the filling operation is terminated if the pressure is below a first pressure indicative of a lack of flow integrity between the source of the bulk liquid and the bulk liquid transport vehicle;

pressurization of the bulk liquid transport vehicle is initiated if the pressure is above the first pressure but below a second pressure necessary for the gas analyzer to properly function by setting the fill valve in the open position and thereafter, closing the fill valve after an elapse of a preset time interval, thereby to introduce an amount of the bulk liquid into the bulk liquid transport vehicle through the fill line;

measurement of purity of the vapor with the gas analyzer is initiated if the pressure is above the second pressure and the filling operation is terminated if the purity of the vapor is below a predetermined purity; and the filling of the bulk liquid transport vehicle with the bulk liquid is initiated by setting the pump in the on condition if the purity of the vapor is at least at the predetermined purity.

2. The automated system of claim 1, further comprising:

a device operable to measure a quantity referable to an amount of the bulk liquid within the bulk liquid transport vehicle and to generate a quantity signal referable to the amount of the bulk liquid within the bulk liquid transport vehicle; and the programmable logic controller being responsive to the quantity signal and programmed to set the pump in the off condition when the amount of the bulk liquid within the bulk liquid transport vehicle is at a predetermined amount and thereafter, to initiate a measurement of composition of the vapor with the gas analyzer.

3. The automated system of claim 2, wherein the device is a scale and the quantity signal is referable to the amount of the bulk liquid contained within the bulk liquid transport vehicle by being referable to the weight of the bulk liquid transport vehicle.

4. The automated system of claim 1 or claim 2, wherein:

the pump is operable to be set in an on condition to pump the liquid and an off condition to turn off the pump; and the programmable logic controller also controls the pump and is programmed such that the pump is set in the on condition for the preset time interval and after the elapse of the preset time interval, the pump is set in the off condition.

5. The automated system of claim 3, wherein:

the programmable logic controller is programmed to reinitiate pressurization of the bulk liquid transport vehicle if the pressure remains below the second pressure necessary for the gas analyzer to properly function after a prior attempt to pressurize the bulk liquid transport vehicle; and the control logic program has a counter to count a number of sequential attempts to pressurize the bulk liquid transport vehicle and to terminate the filling operation if the number of sequential attempts to pressurize the bulk liquid transport vehicle is equal to a predetermined count.

6. The automated system of claim 1, wherein the programmable logic controller is programmed such that the pressure is first tested for the second pressure and if the pressure is below the second pressure, to then test for the first pressure.

7. The automated system of claim 1, wherein the programmable logic controller is programmed to enable the pressurization of the bulk liquid transport vehicle for specific logon identifications of users certified to conduct bulk liquid transport vehicle pressurization operations that are entered into a supervisory control and data acquisition program connected to the programmable logic controller.

8. The automated system of claim 5, wherein the programmable logic controller is programmed such that the pressure is first tested for the second pressure and if the pressure is below the second pressure, to then test for the first pressure.

9. The automated system of claim 8, wherein the programmable logic controller is programmed to enable the pressurization of the bulk liquid transport vehicle for specific logon identifications of users certified to conduct bulk liquid transport vehicle pressurization operations that are entered into a supervisory control and data acquisition program connected to the programmable logic controller.

10. The automated system of claim 9, further comprising:

a manual interlock switch located in the vicinity in which the filling operation is to be conducted, connected to the programmable logic controller and accessible by the users;

the programmable logic controller programmed such that the manual interlock switch must be manipulated by the users before pressurization of the bulk liquid transport vehicle is initiated.

* * * * *